US007762864B2

(12) United States Patent
Moelker

(10) Patent No.: US 7,762,864 B2
(45) Date of Patent: Jul. 27, 2010

(54) NOISE GENERATOR

(76) Inventor: Dale Moelker, 5112 W. Garbow Rd., Middleville, MI (US) 49333

( * ) Notice: Subject to any disclaimer, the term of this patent is extended or adjusted under 35 U.S.C. 154(b) by 65 days.

(21) Appl. No.: 12/174,615

(22) Filed: Jul. 16, 2008

(65) Prior Publication Data

US 2009/0023357 A1 Jan. 22, 2009

Related U.S. Application Data

(60) Provisional application No. 60/959,828, filed on Jul. 17, 2007.

(51) Int. Cl.
*A63H 5/00* (2006.01)
*A63H 33/40* (2006.01)

(52) U.S. Cl. ..... 446/207; 446/202

(58) Field of Classification Search ..... 446/186, 446/213, 204–209, 224, 242, 402, 429; 84/330, 84/250, 349, 360, 361, 362, 363, 364, 375
See application file for complete search history.

(56) References Cited

U.S. PATENT DOCUMENTS

| | | | | | |
|---|---|---|---|---|---|
| 2,551,367 | A * | 5/1951 | Fahey | ..... | 84/380 R |
| 3,066,443 | A * | 12/1962 | Mobley | ..... | 446/204 |
| 3,955,313 | A * | 5/1976 | Faulk | ..... | 446/208 |
| 3,991,513 | A * | 11/1976 | Faulk | ..... | 446/208 |
| 4,211,031 | A * | 7/1980 | Gambino | ..... | 446/208 |
| 6,926,578 | B1 * | 8/2005 | Casias et al. | ..... | 446/202 |
| 7,384,323 | B2 * | 6/2008 | Sceery | ..... | 446/208 |

* cited by examiner

*Primary Examiner*—Nini Legesse
(74) *Attorney, Agent, or Firm*—Robert J. Sayfie

(57) ABSTRACT

An apparatus and method of making noise comprising a noise maker comprising a proximal cylinder portion 20 and a distal cylinder portion 60, a large internal member terminating in at least one finger 38; at least two reeds 40 secured in a manner so that it is positioned adjacent the respective finger 38, but not in contact with the respective finger 38, to create a respective air gap 70 between the finger 38 and the reed 40; whereby at least two air gaps 70 exist for the creation of noise.

3 Claims, 2 Drawing Sheets

NOISE GENERATOR

PRIORITY

This application claims priority from provisional patent application No. 60/959,28 that was filed on 17 Jul. 2007.

REFERENCE NUMERALS

10 noise maker or noise generator
20 proximal cylinder portion
30 large internal member
32 neck
34 shoulder
36 arm
38 finger
39 step
40 small internal member OR reed
50 external member
60 distal cylinder portion
70 air gap
80 air direction
90 wall
100 air intake area
110 exhaust area
120 wall inside diameter
130 proximal cylinder portion inside diameter
140 distal cylinder portion inside diameter
150 centerline

BACKGROUND OF THE INVENTION

This invention relates to a system and method of making noise by blowing air rough the present invention.

Noise makers are used for various social celebrations, including New Year eve parties, sporting events such as football games, and other events. The present invention may also be used for sounding an alarm, signaling device, or to scare animals from brush or landscape.

There is a need for a small, handheld wind instrument that generates high decibel counts, high volume, and in general, a lot of noise.

SUMMARY OF THE INVENTION

One aspect of the present invention is a noise maker comprising a proximal cylinder portion 20 and a distal cylinder portion 60, a large internal member terminating in at least one finger 38; at least two reeds 40 secured in a manner so that it is positioned adjacent said respective finger 38, but not in contact with said respective finger 38, to create a respective air gap 70 between said finger 38 and said reed 40, said air gaps 70 disposed substantially equidistant from said centerline; whereby at least two air gaps 70 exist for the creation of noise.

Another aspect is a method of making noise by displacing air through at least two air gaps 70 disposed substantially equidistant from a centerline 150.

Another aspect is a noise maker comprising a proximal cylinder portion 20 and a distal cylinder portion 60, a large internal member terminating in at least one finger 38; and at least two reeds 40 secured in a manner so that it is positioned adjacent said respective finger 38, but not in contact with said respective finger 38, to create a respective air gap 70 between said finger 38 and said reed 40, said air gaps 70 disposed in an orientation that is not substantially equidistant from said centerline.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, the present invention may be used for making a lot of noise; often referred to as "a racket." This is a wind instrument, also referred to herein as a noise generator is used to make noise. The present invention may be used at parties, sporting events, or other occasions where one wants to celebrate by creating noise and loud horn-like or screaming sounds.

The present invention differs from the prior art by, among other things, the structure is different, which allows it to make a lot of noise relative to its size.

Figure 1:
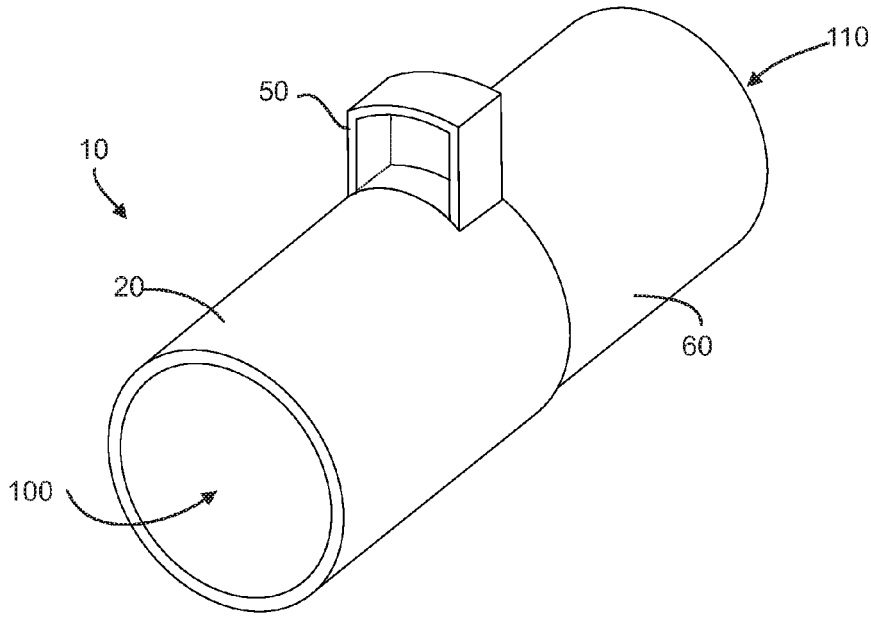
FIG. 1 is a first pictorial of an embodiment of the present invention.

FIG. 1 is a first pictorial of the present invention, referred to as a noise maker or noise generator 10. FIG. 1 illustrates a distal cylinder portion 60 connected to a proximal cylinder portion 20. The proximal cylinder portion 20 may have a larger diameter than the distal cylinder portion 60. As illustrated in FIG. 1, an external member 50 may be generally C-shaped, and extend away from, and be connected to both the proximal cylinder portion 20 and the distal cylinder portion 60. The proximal cylinder portion 20 is hollow so as to have an air intake area 100. Similarly, the distal cylinder portion 60 is hollow so as to define an exhaust area 110. The lips of the user may contact the proximal cylinder portion 20 to blow air through the device 10 and out of the exhaust area 110.

Figure 2:
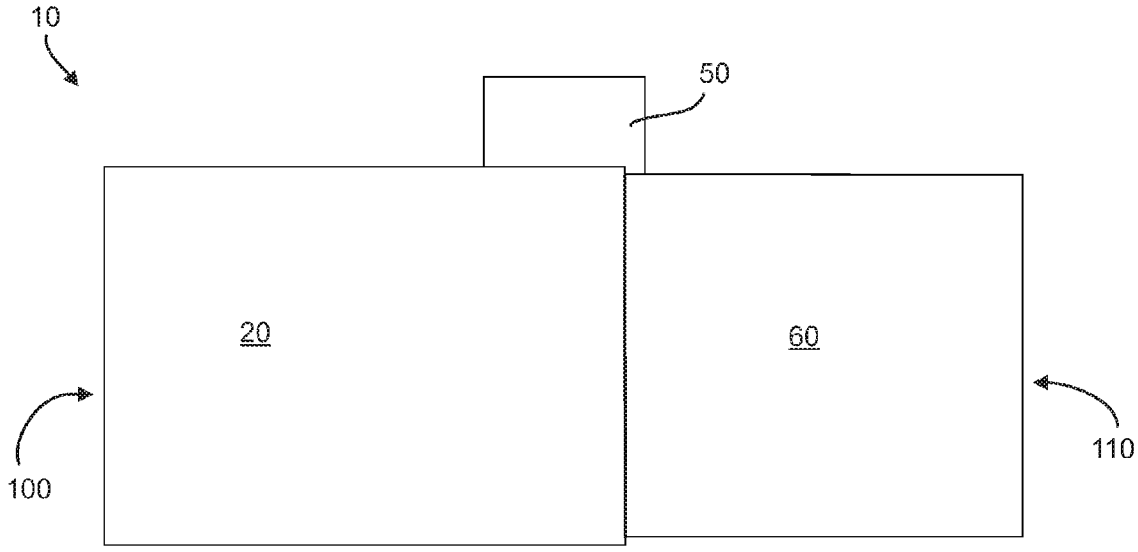
FIG. 2 is a side view pictorial of an embodiment of the present invention.

FIG. 2 illustrates the noise maker 10 has a proximal cylinder portion 20 that is connected to a distal cylinder portion 60. A wall 90 may be disposed between the proximal cylinder portion 20 and the distal cylinder portion 60. The wall 90 may extend inwardly from the distal cylindrical portion 60 to terminate at a wall inside diameter 120. Air may be blown from the air intake area 100 and the air may exit the device 10 at the exhaust area 110.

As illustrated in FIG. 2, the proximal cylinder portion 20 may have a larger outside diameter than the distal cylindrical portion 60. And the proximal cylindrical portion inside diameter 130 may have a smaller inside diameter than the distal cylindrical portion inside diameter 140. A large internal member 30 may extend inwardly from the distal cylinder portion inside diameter 140. The large internal member may have a first neck 32 extending inwardly from the distal cylinder portion inside diameter 140 to a shoulder 34; the shoulder 34 that extends forwardly and slightly inwardly to an arm 36; the arm 36 may extend inwardly beyond the centerline 150 to a finger 38; the finger 38 extends slightly rearwardly.

Figure 4:
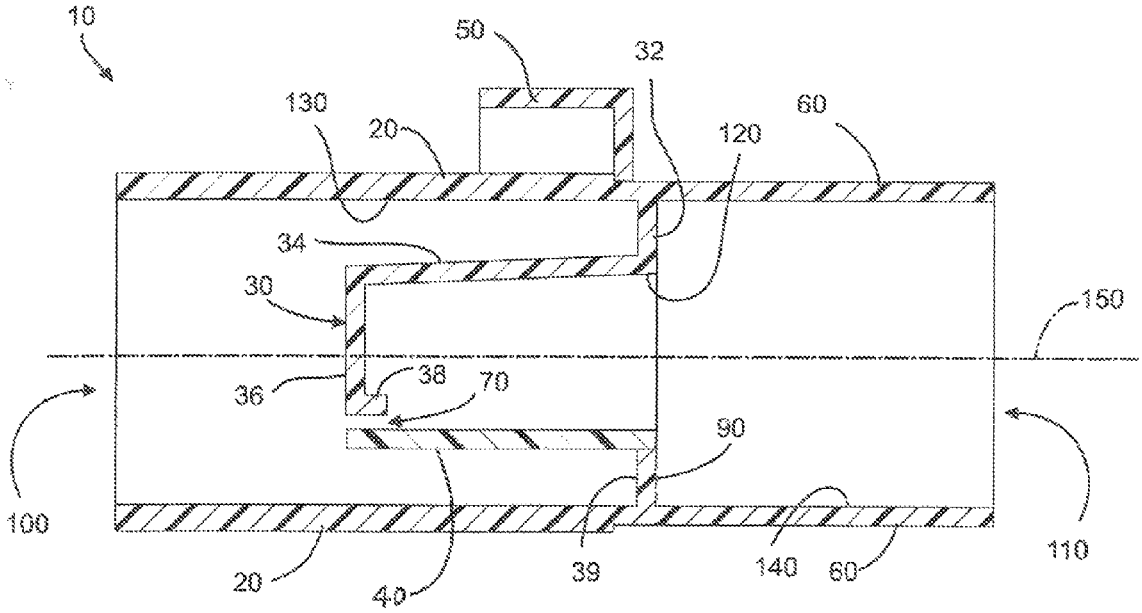
FIG. 4 is a sectional view along line 4-4 of FIG. 3.

As seen in FIG. 4, a reed 40 may be oriented substantially parallel to the centerline 150; and may be secured in a manner whereby an air gap 70 exists between the reed 40 and the finger 38. In one exemplary embodiment the reed 40 may be secured to a step 39. The reed 40 may be secured by an adhesive, a fastener, or it could be integral with the step 39 by means of an injection molding process. In another embodiment the reed 40 may be secured to the wall 90. In one exemplary embodiment the reed 40 and wall 90 do not form a corner. In one exemplary embodiment the wall 90 extends beyond the end of the reed 40 closes to the exhaust area. As air flows from the air intake area 100 toward the exhaust area 110, the moving or displaced air causes the reed 40 to vibrate. The vibrating reed 40 is the source of the sound waves.

Figure 3:
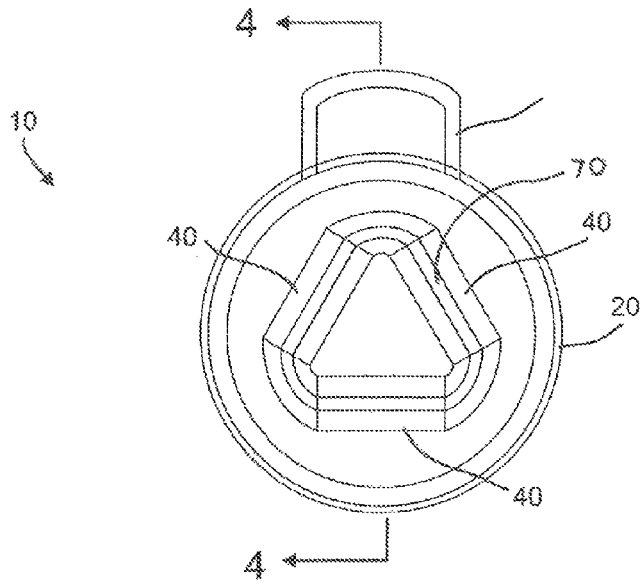
FIG. 3 is a front view of an embodiment the present invention.

As illustrated in FIG. 3, three sets of reeds 40 may be used; thus three large internal members 30 and fingers 38 may respectively be used to form three air gaps 70.

In FIG. 4, the air direction is from left to the right.

In use, the user places the air intake area 100 against the mouth or lips, and then blows or exhales. As the air travels in though the noise maker 10 out of the exhaust area 110, as the air flows though the air gap 70, a loud noise is generated until the air flow stops, or until any appreciable air pressure is decreased.

The reeds 40 and respective air gaps 70 may, but need not be disposed in a position equidistant from the centerline. In fact, the reeds 40 and air gaps 70 may be arranged is any position. In one embodiment the reeds 40 and respective air gaps are positioned in an arbitrary fashion, so long as the reeds 40 and air gaps 70 are capable of creating sound waves at substantially the same time when air is being displaced through the noise generator 10.

It should be understood, of course, that the foregoing relates to exemplary embodiments of the invention and that modifications may be made without departing from the spirit and scope of the invention as set forth in the following claims.

I claim:

1. A noise maker comprising a proximal cylinder portion and a distal cylinder portion, said proximal cylinder portion having a larger external diameter than said distal cylinder portion;

both said proximal cylinder portion and said distal cylinder portion having no holes therethrough;

a large internal member terminating in at least one finger;

at least two reeds secured in a manner so that it is positioned adjacent said respective finger, but not in contact with said respective finger, to create a respective air gap between said finger and said reed, said air gaps disposed substantially equidistant from a centerline;

said reeds disposed concentrically with said large internal member whereby at least two air gaps exist for the creation of noise.

2. The apparatus of claim 1, comprising three respective air gaps, reeds, and fingers.

3. A noise maker comprising a proximal cylinder portion and a distal cylinder portion, a large internal member terminating in at least one finger;

said proximal cylinder portion having a larger external diameter than said distal cylinder portion;

both said proximal cylinder portion and said distal cylinder portion having no holes therethrough; and at least two reeds secured in a manner so that it is positioned adjacent said respective finger, but not in contact with said respective finger, to create a respective air gap between said finger and said reed, said air gaps disposed in an orientation that is not substantially equidistant from a centerline said reeds disposed concentrically with said large internal member.

* * * * *